US005222835A

United States Patent [19]

Wright

[11] Patent Number: 5,222,835

[45] Date of Patent: Jun. 29, 1993

[54] RESIN-MIXING ARTICLE FOR MINE ROOF ANCHOR

[75] Inventor: Raymond L. Wright, Syracuse, N.Y.

[73] Assignee: The Eastern Company, Naugatuck, Conn.

[21] Appl. No.: 887,865

[22] Filed: May 26, 1992

[51] Int. Cl.[5] ..... E21D 20/02

[52] U.S. Cl. ..... 405/259.6; 411/534

[58] Field of Search ..... 405/259.6, 259.5, 269, 405/303; 411/534

[56] References Cited

U.S. PATENT DOCUMENTS

| | | | |
|---|---|---|---|
| 3,298,144 | 1/1967 | Fischer | 405/259.6 X |
| 4,129,007 | 12/1978 | Rausch | 405/259.6 |
| 4,655,645 | 4/1987 | Hipkins et al. | 405/261 |
| 4,664,561 | 5/1987 | Frease | 405/261 |
| 4,746,248 | 5/1988 | Lillis et al. | 405/259.6 X |
| 5,052,861 | 10/1991 | Hipkins, Sr. | 405/261 |

*Primary Examiner*—Dennis L. Taylor
*Attorney, Agent, or Firm*—Charles S. McGuire

[57] ABSTRACT

An article for assisting in the mixing of components of a resin grouting material within a drill hole in a rock formation to form a hardenable mass anchoring the threaded, distal end of an elongated bolt in the hole. The article includes an annular base portion having a central, through opening for threaded engagement with the bolt, and at least one leg extending from the base portion in a direction substantially parallel to the axis of the opening. The article is rotated together with the bolt, the leg having leading and trailing edges with respect to the direction of rotation. The leading edge is a flat surface substantially parallel to the axis of the bolt and the trailing edge is a relatively sharp, linear edge, non-parallel to the bolt axis. The article may be employed in chemical anchors with a single leg extending from the base portion toward the distal end of the bolt, or with a pair of legs extending in opposite directions from the base portion. In another embodiment, the article is employed in a combination chemical-mechanical anchor with the leg extending away from the distal end of the bolt, upon which the mechanical anchor is mounted with the lower end of the shell contacting and supported by the base portion of the article. Downward force exerted by the shell during expansion strips the threaded engagement of the article with the bolt.

26 Claims, 3 Drawing Sheets

RESIN-MIXING ARTICLE FOR MINE ROOF ANCHOR

BACKGROUND OF THE INVENTION

The present invention relates to apparatus for use in anchoring systems for mine roof bolts, and the like; more particularly, the invention relates to systems wherein one end of an elongated bolt is anchored in a drill hole by a hardened mixture of resin components originally separated in a two-compartment container. The resin may provide the sole anchoring means, or may be used in combination with a mechanical anchor.

For many years it has been the conventional practice to support and reinforce mine roofs and other rock structures by anchoring a rod or bolt in a drill hole and tensioning the bolt to urge a bearing plate into compressive engagement with a rock formation surface. Virtually all systems for anchoring a mine roof bolt in a bore hole may be classified as mechanical, chemical, or a combination of the two. Most mechanical anchoring systems employ an expansion anchor threadedly engaged with an end portion of the bolt, and including a shell or leaves which are radially expanded into tightly gripping engagement with the drill hole wall in response to rotation of the bolt.

In so-called chemical anchors, some or all of that portion of the bolt or rod within the drill hole is surrounded by a hardened resin grouting material. It has become the usual, if not universal practice to provide such grouting material in the form of a two-compartment package or cartridge wherein a resin and a catalyst are physically separated until the package is broken within the drill hole to permit mixing of the two components. In present formulations, hardening is essentially complete within a few seconds after mixing. The grouting material sets up harder and faster when the components are thoroughly mixed. Many mixing aids have been proposed to assist in fast and complete mixing as the roof bolt is rotated after it is fully inserted in the drill hole to crush the cartridge and release the components.

Although a large number of designs of mechanical expansion anchors have been proposed for use in mine roof support and stabilization applications, virtually all of those in commercial use include a plurality of radially expansible leaves or fingers and a tapered nut, sometimes referred to as a camming plug. The plug has an internally threaded bore which is engaged with a externally threaded end portion of a bolt, whereby rotation of the bolt in the proper direction moves the plug axially on the bolt threads, forcing the leaves or fingers outwardly into tightly gripping engagement with the drill hole wall The expansion shell, i.e., the leaves or fingers, is held in assembled relation with the plug prior to expansion, and restrained against axial movement as the plug travels down the bolt threads, in one of two ways. In so-called bail type anchors, a metal strap or bail has end portions engaged with the leaves or fingers of the expansion shell and a medial portion passing over the top of the plug. In other anchors, the fingers extend integrally from a ring-like base portion which rests upon a separate support nut threaded on the bolt. The support nut is often in the form of a relatively fragile sheet metal stamping which may be stripped from the bolt threads as downward pressure is exerted on the expansion shell by the camming plug, and thus by the shell on the support nut. In applications employing both chemical and mechanical anchor components, rotation of the bolt to expand the anchor, which typically requires only 2 or 3 seconds, is relied upon to effect mixing of the resin components.

Principal objects of the present invention are to provide a novel article for threaded engagement with a bolt to assist in mixing components of a resin grouting material within a drill hole, and to provide a combined resin-mechanical mine roof bolt anchor having improved resin mixing capabilities.

A further object is to provide an article of manufacture which serves both to support a mine roof expansion anchor shell on a bolt and to aid in efficient mixing of resin components within a drill hole.

Another object is to provide a strippable support nut for an expansion shell with unique structure on the nut for assisting in mixing the components of a resin grouting material as a bolt on which the nut is carried is rotated to expand the shell.

A further object is to provide a combined resin-mechanical roof bolt anchoring system wherein an expansion anchor is fully engaged in a drill hole by rotation of the bolt for the normal amount of time, and the resin components are thoroughly mixed.

Other objects will in part be obvious and in part appear hereinafter.

SUMMARY OF THE INVENTION

In accordance with the foregoing objects, the invention contemplates an article having an annular base portion with a central, internally threaded bore, with one or more legs extending from the base portion in a direction generally parallel to the axis of the bore. The article is preferably formed as a unitary, metal casting, and the internal threads of the bore are formed to mate with external threads which extend from the distal end of an elongated rod or bolt to a thread termination.

In a first disclosed embodiment, the article has a single leg extending from the base and the directions of threads in the bore and on the bolt are such that when the article is threaded onto the bolt, up to the thread termination, the leg extends toward the distal end of the bolt. In a second embodiment, legs extend from the base in opposite directions, both legs being parallel to the bolt axis. In these embodiments, the bolt is anchored entirely by the resin grouting mix which surrounds the article and the distal end of the bolt within a blind drill hole in the rock structure being supported and reinforced.

In a further embodiment, the article is used in conjunction with an expansion anchor in a combined chemical-mechanical anchoring system. The article has a single leg and the thread directions in the article bore and on the distal end of the bolt are such that when the article is threaded onto the bolt, the leg extends toward the proximal end of the bolt. After the article has been threaded up to the thread termination, the expansion anchor is mounted on the bolt in the usual manner, i.e., by threading the bolt through the bore of the camming plug. When fully installed on the bolt, the base of the anchor shell abuts the base of the article which thus serves as a support nut for the expansion anchor.

The thread length in the bore of the article is short enough that the strength of the threaded coupling between the article and the bolt causes the threads on the article to strip as downward pressure is applied by the shell at the onset of shell expansion. This stripping of the threads, in the same manner as the commonly used stamped sheet metal support nuts, tends to prevent so-called false torquing as the expansion anchor is expanded and fixed in the drill hole. A resin cartridge is, of course, inserted in the drill hole in advance of the distal end of the bolt carrying the article and expansion anchor. Rotation of the bolt to set the mechanical anchor rotates the article for a few revolutions, until thread stripping occurs, during which the leg of the article is moved through and assists in mixing the resin components which are released and flow around the distal end of the bolt, the expansion anchor and the article when the cartridge is ruptured. In all embodiments, the leading edge of the leg as it moves through the resin components is a flat surface in a plane radial to, i.e., intersecting the center of, the bore of the mixer base portion. The trailing edge is essentially a line where the inner surface of the leg tapers outwardly to meet the outer surface. In this manner, the flat, leading edge of the leg plows through the resin components to produce maximum intermixture thereof, while the tapered, trailing edge reduces turbulence and voids in the mixed components.

The foregoing and other features of the invention will be more readily understood and fully appreciated from the following detailed description, taken in conjunction with the accompanying drawings wherein:

DETAILED DESCRIPTION

Figure 1:
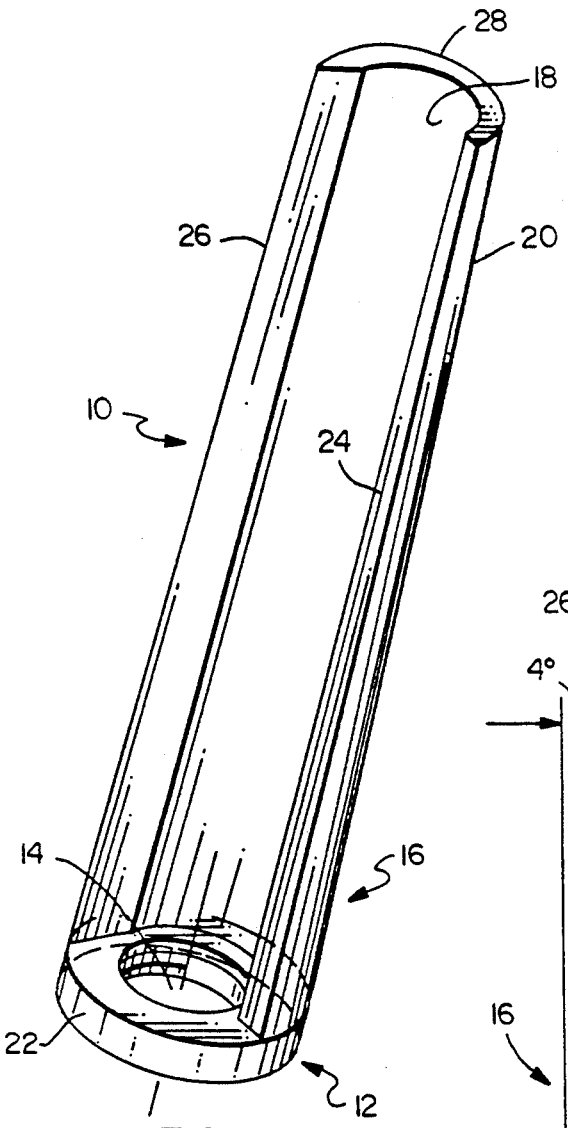
FIG. 1 is a perspective view of a first embodiment of the resin-mixing article of the invention.

Referring now to the drawings, in FIGS. 1–4 is shown a first embodiment of an article of manufacture for mounting upon the distal end of an elongated rod or bolt which is inserted, and thereafter firmly anchored in a drill hole in a rock formation. The article, denoted generally by reference numeral 10, may be conveniently formed as a one-piece casting of, for example, malleable iron. Article 10 includes ring-like base portion 12, having central opening 14, and elongated leg portion 16 extending integrally from base portion 12 in a direction substantially parallel to the axis of opening 14.

Leg 16 has inner and outer surfaces 18 and 20, respectively, which lie in substantially concentric circles in all planes perpendicular to the axis of opening 14. In the illustrated embodiment, base 12 has a cylindrical outer surface 22, concentric with opening 14, the latter being internally threaded. Outer surface 20 of leg 16 lies substantially in the plane of outer surface 22 of base 12, and inner leg surface 18 lies outwardly of the cylindrical plane of opening 14.

Figure 2:
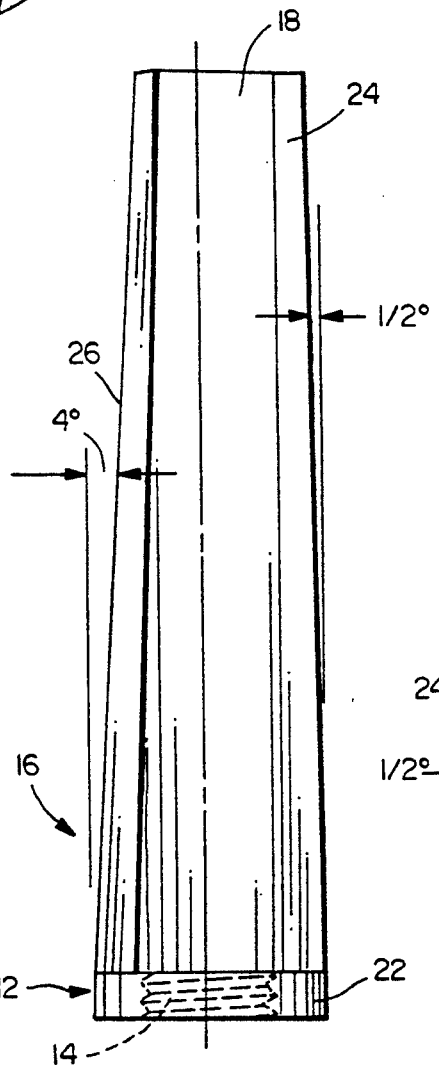
FIG. 2 is a front elevational view of the article of FIG. 1.
Figure 3:
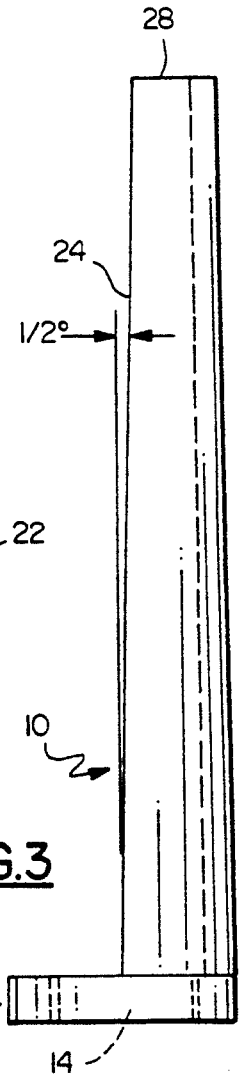
FIG. 3 is a side elevational view of the article of FIGS. 1 and 2.
Figure 4:
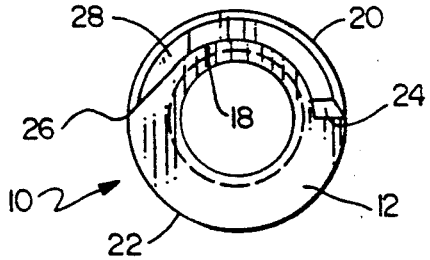
FIG. 4 is a plan view of the article of FIGS. 1–3.

Leg 16 includes first and second longitudinal edges 24 and 26, respectively, which are termed leading and trailing edges for reasons which will later become apparent. Leading edge 24 is flat, having a substantially constant, predetermined width equal to the thickness of leg 16, i.e., the radial distance between inner and outer surfaces 18 and 20. Trailing edge 26 is an essentially sharp edge, formed by the juncture of inner surface 18 tapering outwardly to meet outer surface 20. Leg 16, i.e., inner and outer surfaces 18 and 20, extend circumferentially 180° at the juncture of leg 16 and base 12. Edges 24 and 26 taper inwardly from base 12 to terminal end 28 at preferred draft angles of about 40° and ½°, respectively, as indicated in FIGS. 2 and 3. A preferred draft angle of about ½° of outer surface 20 is also indicated in FIG. 2.

Figure 5:
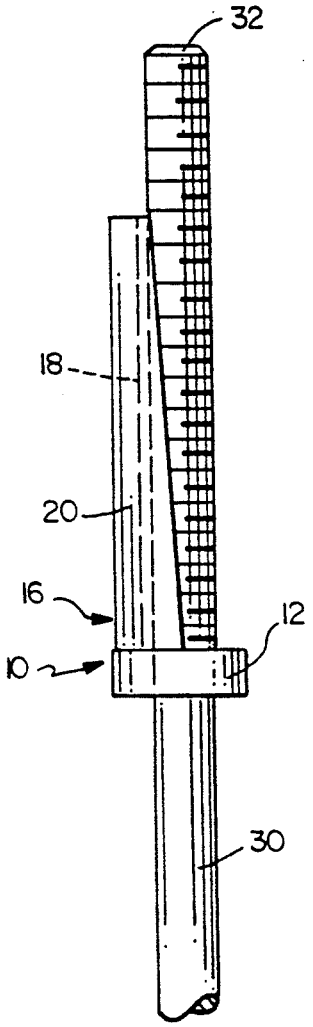
FIG. 5 is a side elevational view of the article of FIGS. 1–4 mounted in a first orientation on the threaded end of an elongated rod.

Article 10 is shown in FIG. 5 mounted upon an elongated rod 30 which is externally threaded for a distance of 6 to 8 inches from its distal end 32, so termed because this end is inserted into a drill hole in a rock formation while the opposite or proximal end remains outside the hole, as explained later. The internal threads of opening 14 mate with the threads on rod 30 in a direction of rotation such that when article 10 is threadedly engaged with rod 30, leg 16 extends from base 12 in the direction of rod distal end 32. By reversing the direction of the threads on one or the other of opening 14 and rod 30, article 10 could be mounted with leg 16 extending from base 12 in a direction away from rod distal end 32.

Figure 6:
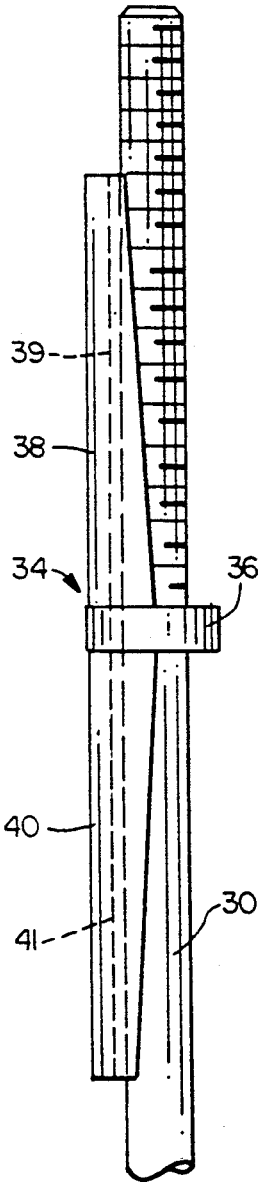
FIG. 6 is a side elevational view of a second embodiment of the article mounted on a threaded rod.

The embodiment of the article denoted by reference numeral 34 in FIG. 6 includes base portion 36 with legs 38 and 40 extending in opposite directions therefrom. Base 36 again includes a threaded, central opening for mating engagement with rod 30, and the configurations of legs 38 and 40 may be the same as that previously described for leg 16. Inner surfaces 39 and 41 of legs 38 and 40, respectively, are indicated in dashed lines in FIG. 6, spaced from the outer surface of rod 30.

Figure 7:
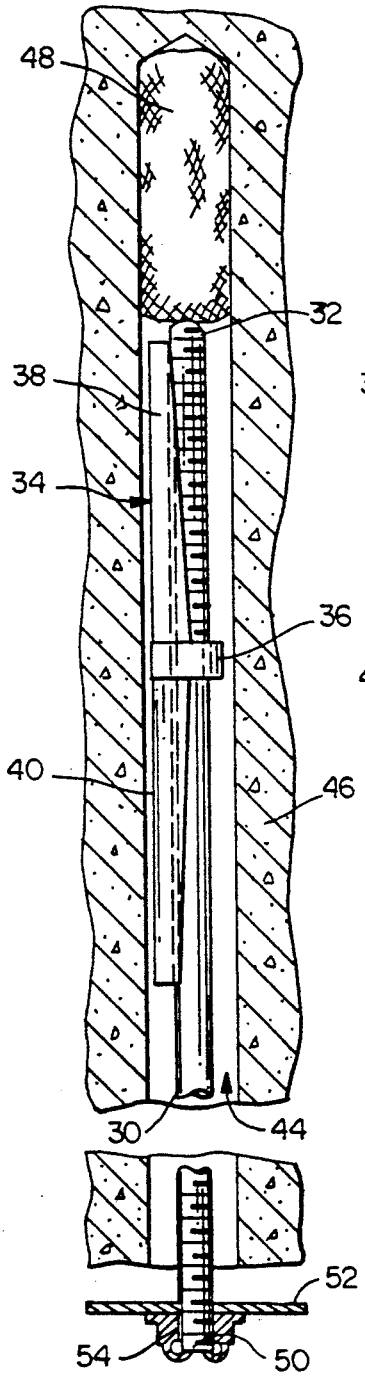
FIGS. 7 and 8 are side elevational views showing the manner of installation of the article of FIG. 6 and rod in a drill hole with the resin grouting material which provides the chemical anchoring of the rod in a rock formation.
Figure 8:
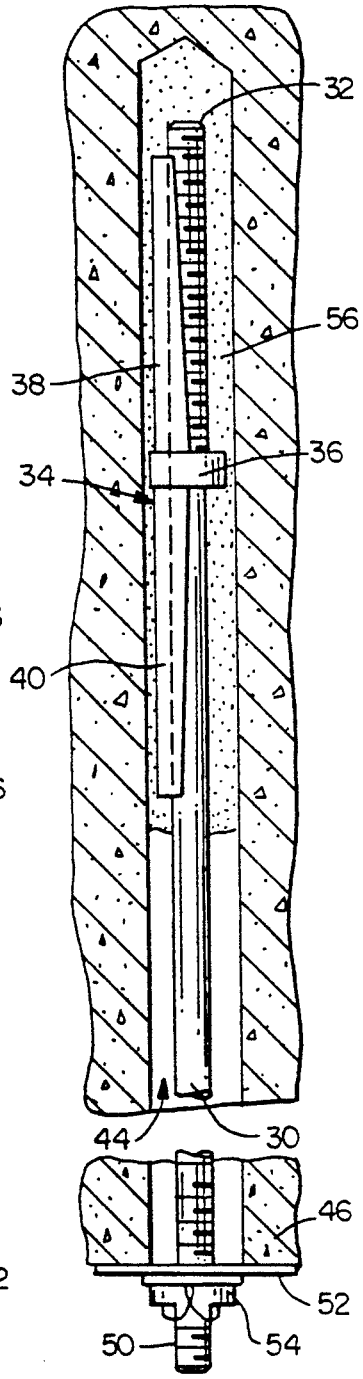

The manner of installation and anchoring of the mixing article and rod of FIG. 5 are illustrated in FIGS. 7 and 8, to which reference is now made. Drill hole 44, of predetermined diameter, e.g., about 3/16" larger than the diameter of the base portion of the article to be installed therein, is drilled in rock formation 46, such as a mine roof. One or more cartridges 48 containing a resin material and a catalyst in separate compartments are inserted into drill hole 44, followed by rod 30 with article 10 carried thereon.

Cartridges such as 48 are entirely conventional, having been used for many years to provide so-called chemical anchors for rods or bolts supporting and reinforcing mine roofs, and the like. The resin and catalyst are in a flowable state as long as they remain separated within cartridge 48, but a few seconds after release and mixing the components solidify to a hardened mass. Such cartridges are available from a number of sources in standard lengths, diameters and mixing/hardening times. The total length of the cartridge(s) inserted in the drill hole is that required to fill the annular space between the rod or bolt and the drill hole wall for the desired length of the chemical anchor. As rod 30 is advanced into drill hole 44, cartridge(s) 48 is crushed by distal end 32 against the blind end of the hole and the resin and catalyst are released to flow around article 34 and a portion of rod 30.

Article 34 is rotationally coupled to bolt 30 in at least one direction of rotation. This may be conveniently accomplished by threading rod 30 from distal end 32 for a predetermined distance, e.g., one or two inches greater than the overall length of article 34, and threading the article on the bolt up to the thread termination. Other means, of course, may also be used to provide the necessary rotational coupling. For example, article 34 may be crimped or spot welded to rod 30, with or without mutually engaged threads.

In the embodiment illustrated in FIGS. 7 and 8, proximal end 50 of rod 30 is also threaded, i.e., the rod is threaded at both ends, and bearing plate 52 and nut 54 are placed thereon. Nut 54 is of the type disclosed in U.S. Pat. No. 4,662,795, having a frangible, domed portion which provides rotational locking of the 15 nut to the rod until a predetermined torque is exceeded. Thus, rod 30 may be advanced into drill hole 44 to break cartridge(s) 48 and release the two components initially contained thereby. Rotation of nut 54 for a few seconds will rotate rod 30 and article 34 to thoroughly mix the components, as shown in FIG. 7.

The direction of rotation is such that flat edges 24 of article 34 are the leading edges and relatively sharp edges 26 are the trailing edges. Mixing of the components is enhanced by the flat, leading edge plowing through the initially flowable materials and the sharp, trailing edge ensuring that turbulence and voids are eliminated or substantially reduced in the mixed components. A few seconds after mixing, the components have hardened to the extent that article 34 and the portion of rod 30 surrounded by grouting mix 56 are firmly anchored and can no longer be rotated. Excess torque applied to nut 54 will then break the frangible dome of the nut, which may then be advanced on the threads of proximal end 50, urging bearing plate 52 into tight engagement with the surface of rock formation 46 surrounding the open end of drill hole 44 and tensioning rod 30 to the desired degree, as seen in FIG. 8.

Figure 9:
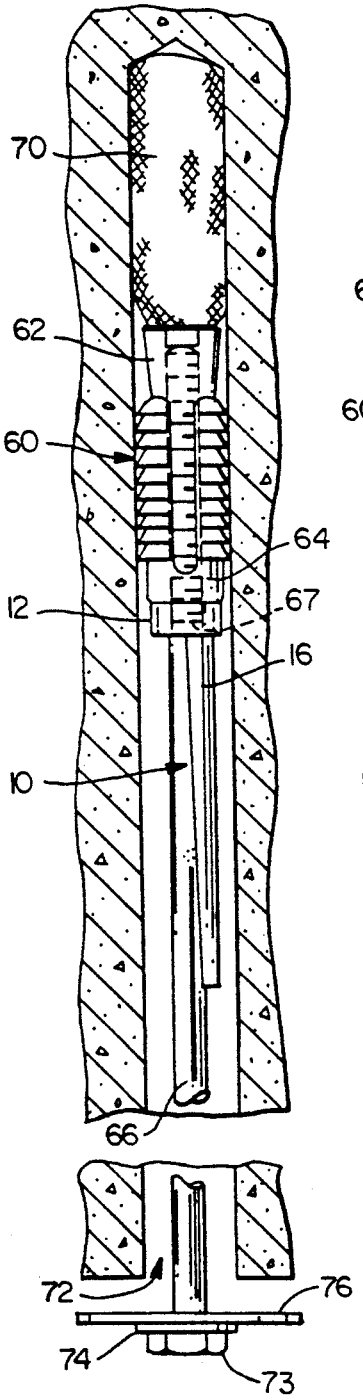
FIGS. 9 and 10 are side elevational views showing the manner of installation of a mechanical expansion anchor together with a resin grouting material and the mixing article to provide a combined mechanical-chemical anchor for the rod.
Figure 10:
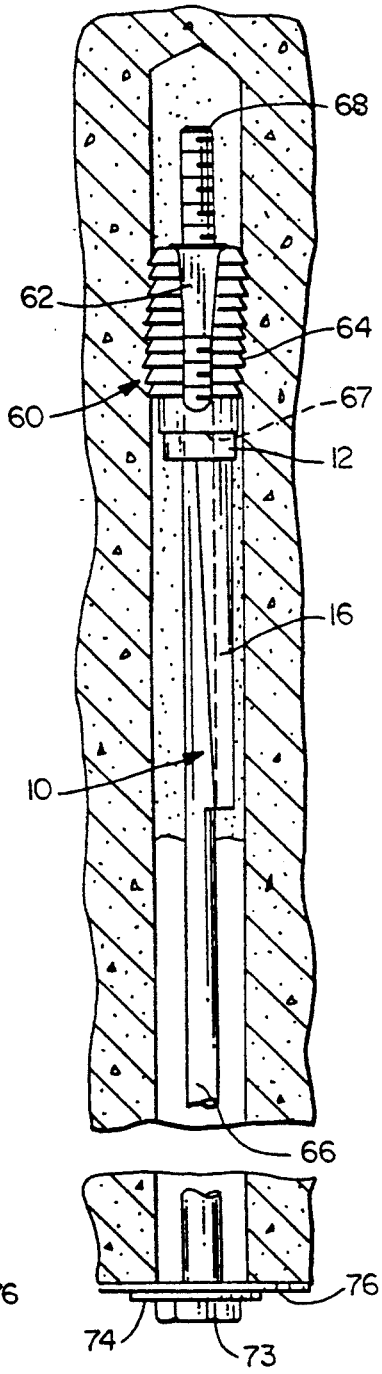

Referring now to FIGS. 9 and 10, an embodiment of the invention providing a combined mechanical-chemical anchor is shown. Expansion anchor assembly 60, of conventional design, includes tapered camming plug 62 and radially expandable shell 64. In the illustrated form, shell 64 is of the type having four leaves or prongs onto bolt 66 up to the thread termination 67. In this case, the mating threads are of such direction that leg 16 extends from base 12 away from distal end 68. Anchor assembly 60 is then mounted upon bolt 66 by threading the bolt through the internally threaded, central bore of plug 62 until the base portion of shell 64 contacts base 12 of article 10.

As seen in FIG. 9, cartridge 70 is inserted in drill hole 72 in advance of bolt 66, carrying article 10 and anchor assembly 60. Bolt 66 has integral head 73 which carries hardened washer 74 and support plate 76. Bolt 66 is fully advanced into drill hole 72, breaking cartridge 70 and permitting the chemical components carried thereby to flow around a portion of the bolt, anchor assembly 60 and article 10. Bolt 66 is then rotated, thereby effecting both mixing of the resin components and expansion of shell 64, as shown in FIG. 10. As previously mentioned, it is preferred that the threaded engagement of the mixing article with the bolt be such that the article is stripped from the bolt threads, in the same manner as conventional support nuts, as the mechanical anchor is expanded. This may be accomplished by a threaded engagement which strips at 60–75 foot-pounds of torque applied to the bolt as the article is held stationary. In FIG. 10, thread termination 67 is shown above base 12 of article 10, as would be the case after the article is stripped from the bolt.

Performance is also improved by keeping the draft angle of leading edge 24, which is necessary when the article is formed as a metal casting, to the previously mentioned minimum, e.g., ½°. This reduces any tendency of article 10 to push the components downwardly, away from anchor assembly 60 in this embodiment.

What is claimed is:

1. An article for threaded engagement with the externally threaded, distal end of an elongated bolt to assist in mixing initially flowable components of a resin grouting material surrounding said distal end and article within a drill hole of substantially uniform diameter in a rock formation to form a solidified mass anchoring said distal end in said drill hole, said article comprising:

a) a ring-like base portion having an opening with a central axis, first and second surfaces lying in spaced planes transverse to said central axis, and internal threads for engagement with said bolt external threads; and b) first and second elongated legs extending in opposite directions from said base portion first and second surfaces, respectively, substantially parallel to said central axis to terminal ends, said legs each being positioned radially outwardly of the cylindrical plane of said opening and extending circumferentially about said central axis for at least 90° and not more than about 270° at their junctures with said base portion between leading and trailing edges with respect to a predetermined direction of rotation of said article about said axis to a point on any surface of said article being less than said uniform diameter, and said leading edges comprise a substantially flat surface of predetermined width extending from said base portion to said terminal ends substantially parallel to said central axis.

2. The article of claim 1 wherein each of said legs extends about said central axis for about 180° at its juncture with said base portion, and for more than 90° and less than 180° at said terminal end.

3. The article of claim 1 wherein said flat surfaces each lie substantially in a radial plane of said central axis.

4. The article of claim 1 wherein each of said trailing edges is a relatively sharp edge.

5. The article of claim 1 wherein said legs each extend circumferentially about said central axis for about 180°.

6. The article of claim 1 wherein each of said legs includes inner and outer surfaces respectively facing toward and away from said central axis.

7. The article of claim 6 wherein said inner and outer surfaces are substantially arranged about said central axis.

8. The article of claim 7 wherein said base portion includes a substantially cylindrical, external surface and said outer surface is substantially an extension of said cylindrical surface.

9. The article of claim 8 wherein said substantially flat surface extends between said inner and outer surfaces in a radial plane of said central axis.

10. The article of claim 9 wherein said trailing edge is a relatively sharp edge, and wherein said inner and outer surfaces converge from concentric planes to meet at said trailing edge.

11. The combination comprising:

a) a rock structure having a surface and a blind drill hole of substantially uniform diameter extending into said rock structure from an open end in said surface;

b) an elongated bolt having a central axis and distal end with external threads extending from said distal end for a predetermined distance to a thread termination, said bolt having a diameter less than said uniform diameter, thereby providing an annular space between said bolt and the wall of said drill hole when said bolt is positioned substantially concentrically within said drill hole;

c) a two-compartment cartridge containing respective components of a grouting material, said components being flowable while separate and hardenable to a solid mass when released from said cartridge and mixed within said annular space; and d) an article to assist in mixing said components, said article comprising:

i) an annular base portion rotationally coupled to said bolt in at least one direction of rotation thereof, whereby said article rotates together with said bolt as said bolt is rotated in said one direction; and ii) at least one elongated leg extending from said base portion within said annular space in a direction substantially parallel to the axis of said bolt to a terminal end, said leg having inner and outer surfaces respectively facing toward said bolt and said drill hole wall in spaced relation to each, said leg extending circumferentially about said annular space for at least 90° and not more than about 270° between leading and trailing edges with respect to said one direction of rotation;

iii) said leading edge comprising a substantially flat surface extending between said inner and outer surface substantially parallel to said bolt central axis.

12. The combination of claim 11 wherein said base portion includes an internally threaded opening threadedly engaged with said bolt external threads.

13. The combination of claim 12 wherein said trailing edge is a relatively shaft edge.

14. The combination of claim 13 wherein said base portion has a cross-dimension smaller than said uniform diameter, whereby said components may flow through said annular space past said base portion.

15. The combination of claim 12 wherein said base portion has first and second surfaces lying in spaced planes parallel to said central axis.

16. The combination of claim 15 wherein a single one of said legs extends from only said first surface.

17. The combination of claim 16 wherein said first surface faces in the direction of said bolt distal end.

18. The combination of claim 15 wherein a first of said legs extends from said first surface and a second of said legs extends from said second surface.

19. The combination of claim 18 wherein said trailing edge of each of said first and second legs is a substantially sharp edge.

20. An anchoring system for supporting and reinforcing a rock formation having a blind drill hole of substantially uniform diameter therein, said system comprising:

a) an elongated bolt having a central axis and a distal end with external threads extending from said distal end for a predetermined distance to a thread termination, said bolt having a diameter less than said uniform diameter, thereby providing an annular space between said bolt and the wall of said drill hole when said bolt is positioned substantially concentrically within said drill hole;

b) a two-compartment cartridge containing respective components of a grouting material, said components being flowable while separate and hardenable to a solid mass when released from said cartridge and mixed within said annular space; and c) a mechanical expansion anchor including:

i) a tapered camming plug having an internally threaded, through bore threadedly engaged with said bolt distal end, said plug having relatively larger and smaller diameter ends respectively facing toward and away from said bolt distal end; and ii) a shell portion having a plurality of leaves arranged substantially concentrically about and in spaced relation to said bolt, said shell portion being positioned farther from said bolt distal end than said larger end of said plug, the dimensions and positioning of said plug and shell portion relative t said drill hole being such that said shell portion is expanded radially outwardly by axial movement of said plug on said bolt in a direction away from said bolt distal end in response to rotation of said bolt in a predetermined direction while restraining said plug and shell portion against rotation and said shell portion against downward axial movement relative to said bolt; and d) an article to assist in mixing at least portions of said components and in supporting and restraining said shell portion against axial movement, said article comprising:

i) a base portion having an upper surface and an internally threaded, through opening threadedly engaged with said bolt distal end; and ii) an elongated leg extending integrally from said base portion in a direction away from said distal end and substantially parallel to the axis of said opening and away from said distal end when said element is threadedly engaged with said bolt, said leg extending circumferentially about said base portion at the juncture of said leg and said base portion for at least 90° and not more than about 270°, said leg having an inner surface facing and spaced from said bolt and an outer surface facing and spaced from the wall of said drill hole when said bolt is positioned substantially coaxially therein;

e) said shell portion having a lower end contacting, and thereby supported and restrained against downward axial movement by said base portion upper surface, said axial movement of said plug in response to rotation of said bolt serving to exert a downward force of at least a predetermined magnitude on said shell, and the threaded engagement of said base portion with said bolt having a predetermined strength less than said predetermined magnitude of downward force, whereby said base portion is stripped from said threaded engagement with said bolt as said shell is expanded.

21. The anchoring system of claim 20 wherein said leg portion includes leading and trailing edges with respect to said predetermined direction of bolt rotation, and said leading edge is a substantially flat surface.

22. The anchoring system of claim 21 wherein said leading edge extends substantially linearly from said base portion to a terminal end in a direction substantially parallel to the axis of said opening.

23. The anchoring system of claim 22 wherein said trailing edge is a relatively sharp edge.

24. The anchoring system of claim 23 wherein said trailing edge extends substantially linearly from base portion to a terminal end in a direction non-parallel to the axis of said opening.

25. The anchoring system of claim 24 wherein said leg extends circumferentially about said base portion at the juncture of said leg and said base portion for about 180°.

26. The anchoring system of claim 25 wherein said terminal end extends circumferentially in a plane substantially perpendicular to the axis of said through opening for less than 180° and more than 90°.

* * * * *